US006719134B2

(12) United States Patent
Phillips et al.

(10) Patent No.: US 6,719,134 B2
(45) Date of Patent: Apr. 13, 2004

(54) TOILET PLUNGER STORAGE DEVICE

(76) Inventors: Vincent R. Phillips, 635 Elton St., Brooklyn, NY (US) 11208; Howard C. Phillips, III, 8000 Shorefront Pkwy., Far Rockaway, NY (US) 11693; Robert D. Wise, 760 Ridgecrest Rd., Akron, OH (US) 44303

( * ) Notice: Subject to any disclaimer, the term of this patent is extended or adjusted under 35 U.S.C. 154(b) by 17 days.

(21) Appl. No.: 10/061,973

(22) Filed: Jan. 31, 2002

(65) Prior Publication Data

US 2002/0100705 A1 Aug. 1, 2002

Related U.S. Application Data

(60) Provisional application No. 60/265,796, filed on Feb. 1, 2001.

(51) Int. Cl.[7] ..... A45C 11/26

(52) U.S. Cl. ..... 206/349; 206/361; 4/255.05; 4/255.11; D6/524

(58) Field of Search ..... 206/349, 361, 206/15.3, 15.2, 209, 581, 225, 823; 4/255.05, 255.11, 255.01; D6/551, 525, 524; D7/361; D9/434; 220/735, 736, 752; 116/110.1

(56) References Cited

U.S. PATENT DOCUMENTS

| | | | | | |
|---|---|---|---|---|---|
| 2,448,603 | A | | 9/1948 | Kevin et al. | |
| D214,454 | S | | 6/1969 | Warnberg | |
| 4,211,750 | A | | 7/1980 | Gillespie | |
| D292,631 | S | * | 11/1987 | Tash | D32/14 |
| 4,776,456 | A | | 10/1988 | Lewis | |
| D315,269 | S | | 3/1991 | Brazis | |
| 5,040,679 | A | | 8/1991 | Rehmann | |
| 5,456,356 | A | | 10/1995 | Kurzawa | |
| D368,820 | S | | 4/1996 | Sander | |
| D383,935 | S | | 9/1997 | Zawalsky | |
| 5,836,322 | A | | 11/1998 | Borger et al. | |
| D404,951 | S | | 2/1999 | Zawalsky | |
| 5,924,566 | A | * | 7/1999 | Gibbs | 206/361 |
| 5,927,492 | A | | 7/1999 | Moore | |
| 6,035,456 | A | * | 3/2000 | Taylor | 4/255.11 |
| 6,038,709 | A | | 3/2000 | Kent | |
| D450,964 | S | | 11/2001 | Johnson | |
| D463,698 | S | * | 10/2002 | Phillips et al. | D6/524 |

OTHER PUBLICATIONS

Webpage from www.plungees.com, viewed on Jan. 31, 2002, showing a PLUNGEMATE toilet plunger cover/holder.

Webpage from www.plungermate.com, viewed on Jan. 31, 2002, showing a clamshell–type toilet plunger holder.

Webpage from www.catalogcitys.com, viewed on Jan. 31, 2002, showing a PLUNGEES toilet plunger holder.

* cited by examiner

*Primary Examiner*—Jila M. Mohandesi
(74) *Attorney, Agent, or Firm*—Rankin, Hill, Porter & Clark LLP

(57) ABSTRACT

A toilet plunger storage device includes a fluid-impervious receptacle to receive an elastomeric suction head portion of a toilet plunger and a cover fitted to the receptacle that receives the handle portion of the plunger. The receptacle includes a conical side wall from which a straight-sided cylindrical portion projects upwardly. The cover has a generally conical member at its lower end and an elongate, hollow, tapered tube that projects from the upper end of the conical member. The upper end of the cylindrical portion and the lower end of the cover are configured to engage each other in bayonet-type telescopic fashion to establish a sealing and locking relationship. A first handle extends from the side of the receptacle and a second handle is disposed at the top of the cover. The device can be formed integrally from a conventional plastics material such as high density polypropylene or polyethylene in a single, inexpensive molding operation. Upon being removed from the mold, a single circumferential cut can be made to separate the molded part into a cover and a receptacle. After any undesired flashing has been removed, the device is ready for service.

11 Claims, 3 Drawing Sheets

TOILET PLUNGER STORAGE DEVICE

REFERENCE TO PROVISIONAL APPLICATION

This application incorporates by reference and claims priority from U.S. provisional patent application No. 60/265,796, filed Feb. 1, 2001.

BACKGROUND OF THE INVENTION

1. Field of the Invention

The invention relates to toilet plungers and, more particularly, to a storage device for toilet plungers that is effective, inexpensive, and attractive.

2. Description of the Prior Art

It is known to provide various types of containers, covers, or holders for toilet plungers. For example, the patent to Kent, U.S. Pat. No. 6,038,709, discloses a toilet plunger holder and cover that includes a generally cylindrical receptacle within which the elastomeric suction head portion of the plunger is disposed. A generally flat cover is adapted to be connected to the receptacle. The cover includes an elongate cylindrical portion that is adapted to be fitted about the handle of the plunger when the cover is connected to the receptacle. Other representative devices are disclosed in various patents, including those to Rehmann, U.S. Pat. No. 5,040,679; Kurzawa, U.S. Pat. No. 5,456,356; Sander, U.S. Des. 368,820; Zawalsky, U.S. Des. 383,935; Borger, et al., U.S. Pat. No. 5,836,322; Zawalsky, U.S. Des. 404,951; and Moore, U.S. Pat. No. 5,927,492.

Although the foregoing devices provide a technique to store a toilet plunger in a covered manner, certain problems have not been addressed. One of these problems is that the various prior art receptacles and covers (if provided) are not particularly attractive. Another problem is that the user cannot readily carry or manipulate the receptacles and/or covers. Another problem is that the devices are not particularly stable, such that they can be tipped over easily and cause any disinfectant or cleaning solution contained in the receptacle to be spilled. An additional problem is that the covers are not childproof. Yet another problem is that the devices are more expensive than desired, in part due to increased manufacturing expenses arising from the unusual or complex shapes of the devices. Desirably, a toilet plunger holder would be available that would be attractive, easy to carry and manipulate, tip-resistant, childproof, and easy and inexpensive to manufacture.

SUMMARY OF THE INVENTION

In response to the foregoing concerns, the present invention provides a new and improved toilet plunger storage device. The present invention has a fluid-impervious receptacle to receive an elastomeric suction head portion of a toilet plunger. The receptacle includes a conical side wall from which a straight-sided cylindrical portion projects upwardly. The upper end of the cylindrical portion is configured to receive a cover in locking relationship. A handle extends from the side of the receptacle.

The invention includes a cover. The cover has a generally conical member at its lower end and an elongate, hollow tapered tube that projects from the upper end of the conical member. The lower end of the conical member is configured to engage the upper end of the receptacle in locking relationship. In the preferred embodiment, the locking relationship between the cover and the receptacle is made by a bayonet-type connection in which projecting lugs from one of the members engage right-angled grooves included as part of the other member. An elliptical handle is disposed at the upper end of the tube.

If the receptacle and the cover are manufactured to suitable tolerances, a seal will be established between the receptacle and the cover that will minimize or prevent the escape of liquids of gases. Although it is not believed to be necessary, it would be possible to improve the seal between the receptacle and the cover by including a gasket as part of either or both of the receptacle or the cover.

The entire device can be formed integrally in a single, inexpensive molding operation. Preferably, the device is blow-molded by using a conventional plastics material such as high density polypropylene or polyethylene. The plastics material can be provided with various additives such as dyes. Upon being removed from the mold, a single circumferential cut can be made to separate the molded part into a cover and a receptacle. After any undesired flashing has been removed, the device is ready for service.

The receptacle has a wide base, and thereby will resist being tipped over. Because the receptacle is hollow and is made in an integral manner, it is fluid-tight and can be filled with disinfectant. The assembled device can be carried easily from place to place due to the elliptical handle at the top of the cover. The receptacle can be emptied out and cleaned readily due to the handle that is included as part of the receptacle. The engagement between the receptacle and the cover provides a seal that prevents odors and fluids from escaping. Because the cover and the receptacle are locked together by the bayonet connection, the device is childproof. Due to the particular shape of the device and because it can be molded from a variety of plastics materials in a variety of colors, the device is attractive to consumers. Because the device can be made from a plastics material in a molding operation, it is quite inexpensive.

The foregoing and other features and advantages of the invention will be apparent from studying the specification and reviewing the accompanying drawings that illustrate the invention.

DESCRIPTION OF THE PREFERRED EMBODIMENT

Figure 1:
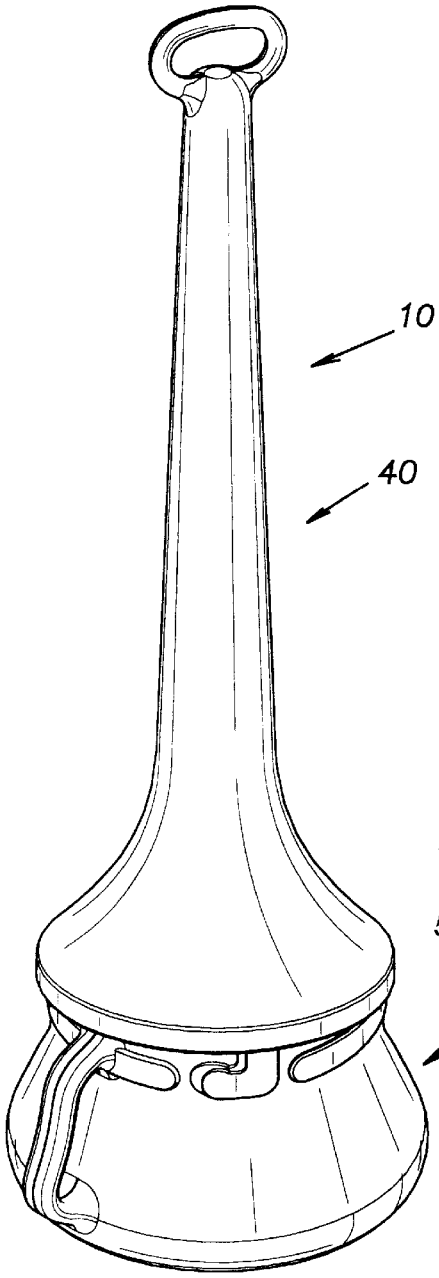
FIG. 1 is a perspective view of a toilet plunger storage device according to the invention.
Figure 2:
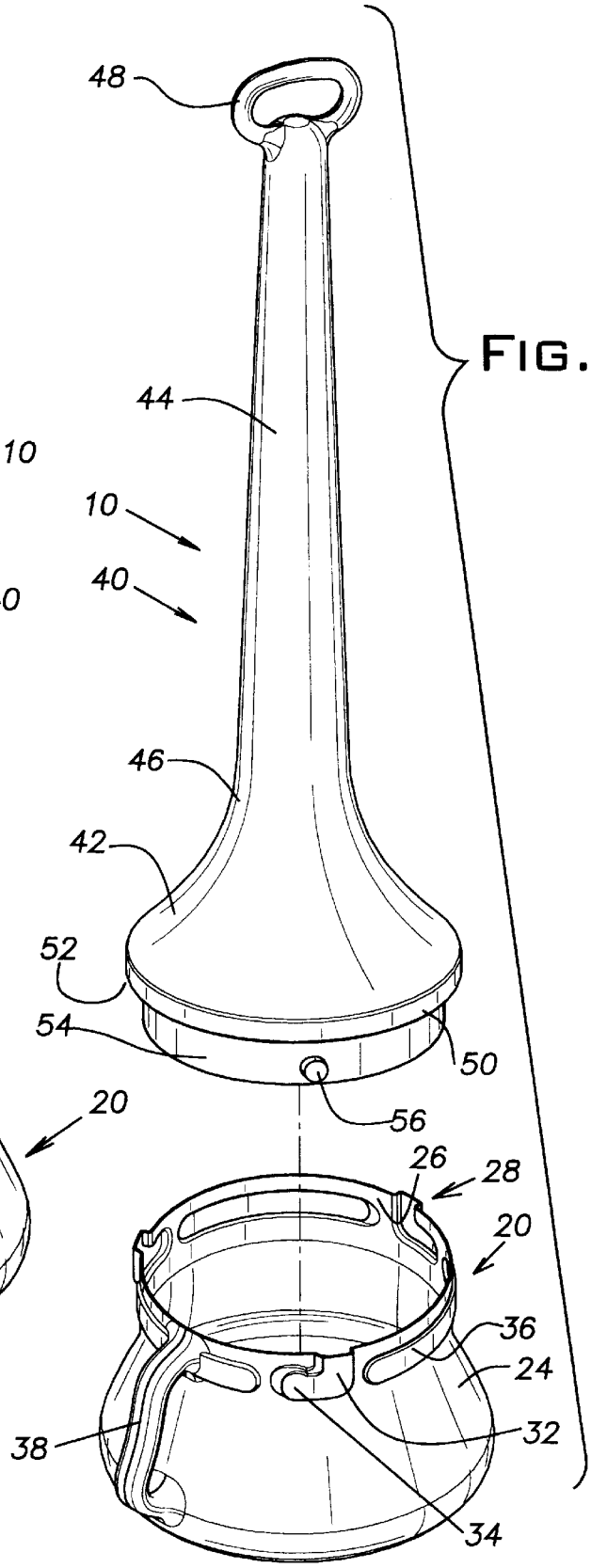
FIG. 2 is a perspective view similar to FIG. 1 showing a cover separated from a receptacle.
Figure 3:
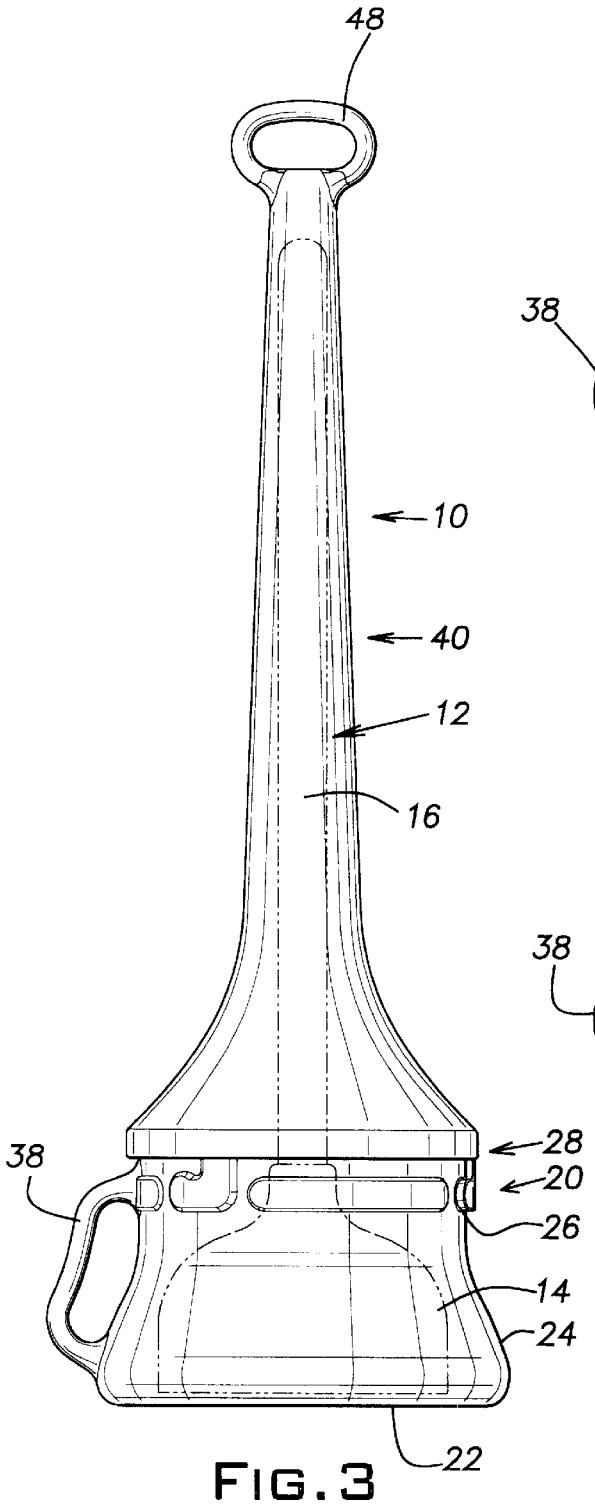
FIG. 3 is a side elevation view of the device of FIG. 1.
Figure 4:
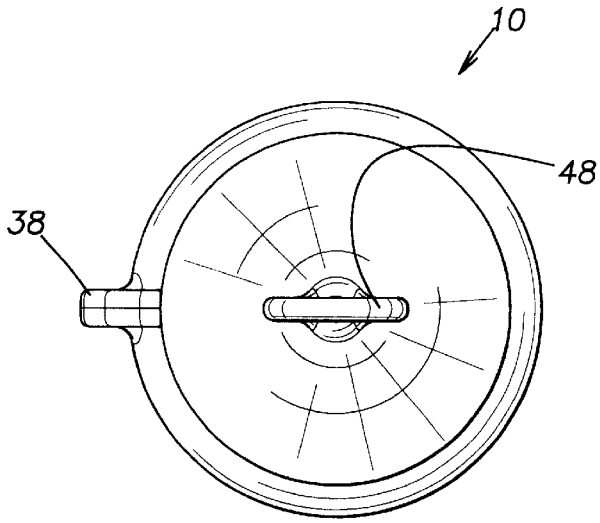
FIG. 4 is a top plan view of the device of FIG. 1.
Figure 5:
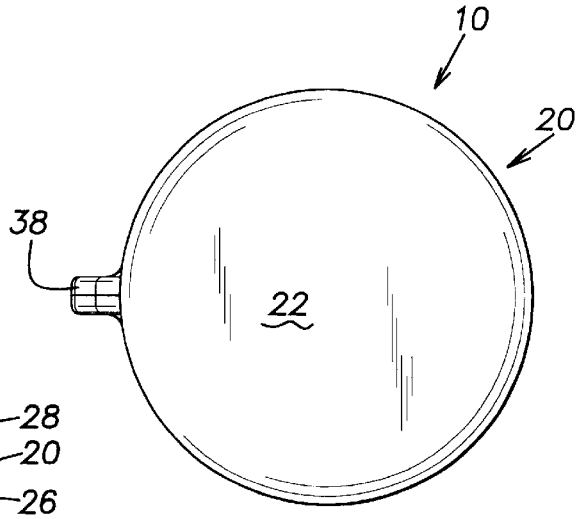
FIG. 5 is a bottom plan view of the device of FIG. 1.
Figure 6:
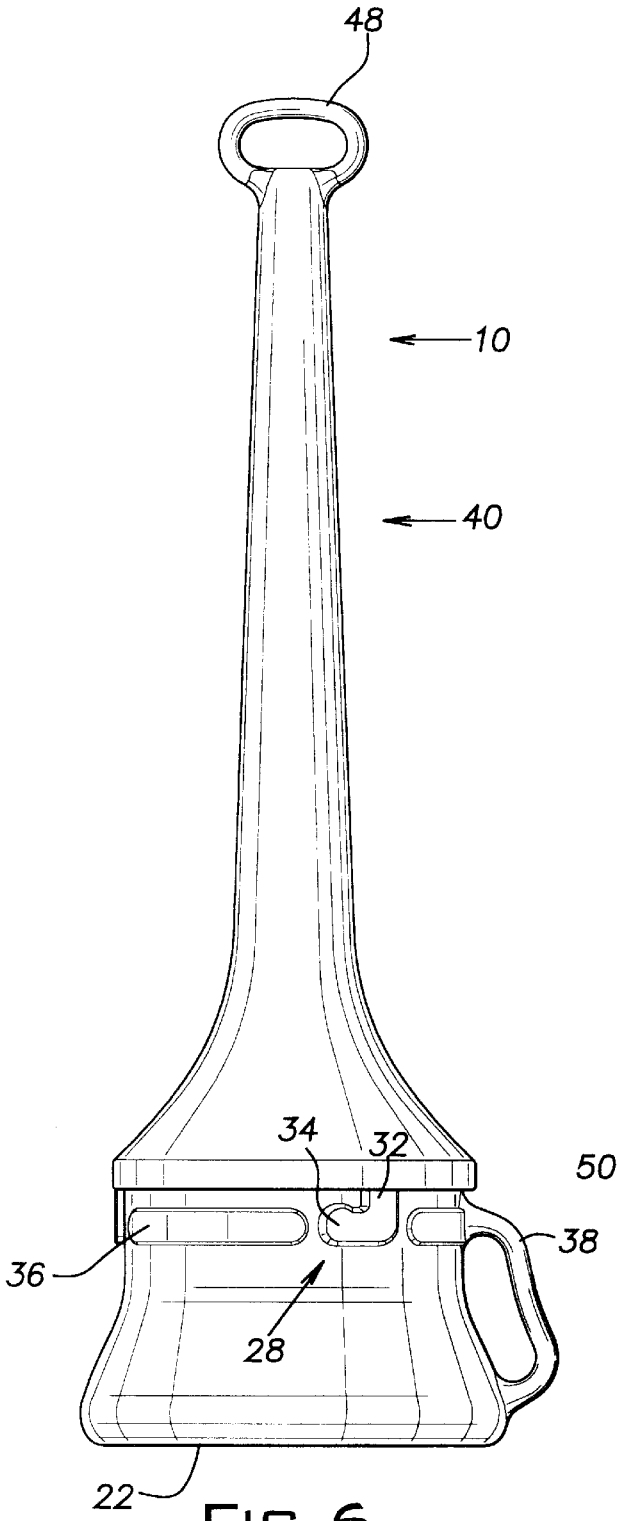
FIG. 6 is a side elevation view of the device of FIG. 1 taken from the side opposite to that shown in FIG. 3.
Figure 7:
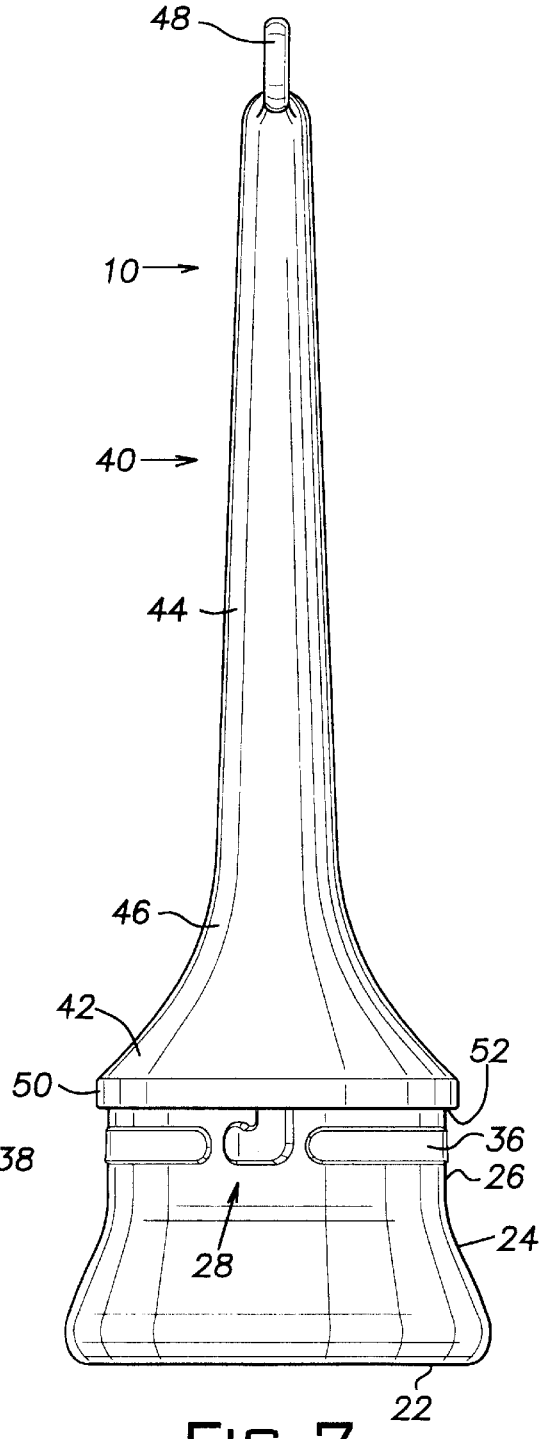
FIG. 7 is a side elevation view of the device of FIG. 1 taken from the right in FIG. 3.

Referring to FIGS. 1–7, a toilet plunger storage device according to the invention is indicated generally by the reference numeral 10. The storage device 10 is intended to receive a conventional toilet plunger 12 (shown in dashed lines in FIG. 3) that has a hollow, flexible, elastomeric suction head portion 14 from which an elongate, cylindrical handle 16 extends.

The storage device 10 includes a receptacle 20. The receptacle 20 has a bottom wall 22, a conical, inwardly tapered side wall 24, and a cylindrical extension 26 that extends upwardly from the upper end of the side wall 24. The bottom wall 22 is flat. The extension 26 is provided with three right-angled grooves 28 at its open end. Each of the grooves 28 has a vertical portion 32 and a horizontal portion 34. The vertical portions 32 are spaced 120 degrees from each other. The horizontal portions 34 are rounded at their ends. The spaces between adjacent grooves 28 are occupied by horizontally extending relief portions 36. The relief portions 36 provide a balanced look to the extension 26, and also strengthen the extension 26.

A hollow handle 38 is integrally formed as part of the receptacle 20. The upper end of the handle 38 is connected to the extension 26 near the intersection with the side wall 24. The lower end of the handle 38 is connected to the lower end of the side wall 24.

The receptacle 20 is hollow in order to receive the elastomeric suction head portion 14 of the plunger 12. The receptacle 20 can be filled with a disinfectant, cleaning or deodorizing fluid in which the head portion 14 can be immersed for storage.

The storage device 10 includes a cover 40. The cover 40 has a generally conical portion 42. An elongate, tapered hollow tube 44 projects from the upper end of the conical portion 42 and is joined thereto by a smoothly contoured portion 46. The upper end of the tube 44 is provided with an elliptical, hollow handle 48 that is formed integrally with the tube 44. The handle 48 is configured to receive the fingers of the user's hand. A small side wall 50 extends vertically downwardly from the lower edge of the conical portion 42. A ledge 52 extends radially inwardly from the bottom end of the side wall 50. A cylindrical sleeve 54 extends vertically downwardly from the inner edge of the ledge 52. Three cylindrical lugs 56 project radially outwardly from the sleeve 54. The lugs 56 are spaced 120 degrees from each other. It is intended that the diameter of the sleeve 54 will be such as to enable it to fit within the cylindrical extension 26 in a telescoping manner.

The device 20 can be formed integrally in a single, inexpensive blow-molding operation from a plastics material such as high density polyethylene, polypropylene, or other suitable material. The material can be provided with various additives such as dyes in order to make the device any desired color. The plastics material is liquified, either before or after being placed in the mold, and then is distributed uniformly on the inner surface of the mold by the application of pressure. The mold is shaped so that the part line of the mold runs through a plane that bisects the handles 38, 48. After the now-solidified plastics material is removed from the mold, the receptacle 20 and the cover 40 are separated from each other by making a circumferential cut between the upper end of the extension 26 and the lower end of the sleeve 54. After removing any flashing, the device 10 is ready for service. The general technique of blow-molding articles made of plastics materials such as polyethylene is known to those skilled in the art, and therefore does not need to be described in further detail here.

Typical dimensions for the receptacle 20 are about 8.375 inches for the largest diameter (which occurs near the intersection of the bottom wall 22 and the side wall 24), about 6.5 inches for the inner diameter of the extension 26, about 5.0 inches from the bottom wall 22 to the top of the extension 26, and about 1.75 inches for the height of the extension 26. The grooves 28 are about 0.5 inch in width. Typical dimensions for the cover 40 are about 22.5 inches for the distance between the top of the handle 48 to the bottom of the sleeve 54, about 6.375 inches for the outer diameter of the sleeve 54, about 8.125 inches for the diameter of the side wall 50, and about 0.5 inch for the diameter of the lugs 56. The tube 44 tapers linearly from a diameter of about 2.375 inches at the intersection with the contoured portion 46 to a diameter of about 1.375 inches near the handle 48. The wall thickness of the receptacle 20 and the cover 40 is about 0.09 inch, although some variation in wall thickness is expected and generally is not harmful.

If the device 10 is manufactured to close tolerances, there is no need for a gasket at the intersection between the receptacle 20 and the cover 40. However, it would be possible, if desired, to provide a gasket or other type of seal for the upper end of the extension 26, for the sleeve 54 at the intersection with the ledge 52, or both.

It will be appreciated from the foregoing description that the invention provides significant advantages over prior devices. Because the bottom wall 22 of the receptacle 20 has a large diameter, the device 10 will resist being tipped over. Because the receptacle 20 is hollow and is made in an integral manner from a plastics material, it is fluid-tight and can be filled with disinfectant, cleaning, or deodorizing fluid. The device 10 can be moved easily by grasping the handle 48, and the receptacle 20 can be emptied out and cleaned readily by grasping the handle 38. The interaction of the lugs 56 and the grooves 28, particularly the rounded ends of the horizontal portions 34, established a bayonet-type connection that causes the cover 40 and the receptacle to be locked to each other so as to render the device childproof. The tight fit between the cover 40 and the receptacle 20 prevents odors and fluid from escaping. Due to the particular shape of the device 10 and because the device 10 can be molded from a variety of plastics materials in a variety of colors, the device 10 is attractive to consumers. Also, because the device 10 can be made from a plastics material in a molding operation, it is quite inexpensive to manufacture.

Although the invention has been disclosed in its preferred embodiment, it will be apparent to those skilled in the art that various changes and modifications can be made thereto without departing from the true spirit and scope of the invention as hereinafter claimed. Merely by way of example and not by way of limitation, it is possible to interchange the grooves 28 and the lugs 56, that is, the grooves 28 could be included as part of the cover 40 and the lugs 56 could be included as part of the receptacle 20. It is intended that the patent shall cover, by suitable expression in the appended claims, all such changes and modifications.

What is claimed is:

1. A toilet plunger storage device for storing a toilet plunger of the type having an elastomeric suction head from which an elongate handle projects, comprising:

a receptacle of a size and shape to receive the suction head, the receptacle having a bottom wall larger in diameter than the suction head, a conical side wall extending upwardly from the bottom wall, the side wall tapering to a narrower dimension at its upper end, a cylindrical extension extending upwardly from the side wall, and a handle extending outwardly of the side wall; and a cover of a size and shape to receive the elongate handle of the plunger and to establish a seal with the cylindrical extension, the cover including:

a conical portion having an outer diameter that approximates that of the cylindrical extension;

an elongate hollow tube;

a contoured section joining the conical portion and the tube;

a handle disposed at the upper end of the tube;

a side wall that extends vertically downwardly from the lower edge of the conical portion;

a ledge that extends radially inwardly from the bottom end of the side wall;

a cylindrical sleeve that extends downwardly from the conical portion of the cover; and a locking connection between the cover and the receptacle, the locking connection being established by a plurality of lugs projecting radially from a selected one of the cylindrical sleeve or the cylindrical extension and a plurality of right-angled grooves that are adapted to receive the lugs and which are included as part of the other of the cylindrical sleeve or the cylindrical extension.

2. The device of claim 1, wherein the handle on the cover is elliptical and is formed integrally with the tube.

3. The device of claim 1, wherein the cylindrical sleeve fits within the cylindrical extension in a telescoping manner, the lugs project radially outwardly from the cylindrical sleeve, and the grooves are formed on the cylindrical extension.

4. The device of claim 3, further comprising relief portions included as part of the cylindrical extension, the relief portions extending between adjacent grooves.

5. The device of claim 1 wherein the device is made of a plastics material such as high density polyethylene or polypropylene.

6. A toilet plunger storage device for storing a toilet plunger of the type having an elastomeric suction head from which an elongate handle projects, comprising:

a receptacle of a size and shape to receive the suction head; and a cover of a size and shape to receive the elongate handle of the plunger and to establish a seal and a bayonet-type locking connection with the receptacle, the cover including:

a conical portion having an outer diameter that approximates that of the receptacle;

an elongate hollow tube;

a contoured section joining the conical portion and the tube;

a handle disposed at the upper end of the tube;

a side wall that extends vertically downwardly from the lower edge of the conical portion;

a ledge that extends radially inwardly from the bottom end of the side wall;

a cylindrical sleeve that extends downwardly from the conical portion of the cover;

a plurality of lugs projecting radially from a selected one of the cylindrical sleeve or the cylindrical extension; and a plurality of right-angled grooves that are adapted to receive the lugs and which are included as part of the other of the cylindrical sleeve or the cylindrical extension.

7. The device of claim 6, wherein the handle disposed at the upper end of the tube is elliptical and is formed integrally with the tube.

8. The device of claim 6, wherein the receptacle has a bottom wall larger in diameter than the suction head, a conical side wall extending upwardly from the bottom wall, the side wall tapering to a narrower dimension at its upper end, and a handle extending outwardly of the side wall.

9. The device of claim 6, wherein the cylindrical sleeve fits within the cylindrical extension in a telescoping manner, the lugs project radially outwardly from the cylindrical sleeve, and the grooves are formed on the cylindrical extension.

10. The device of claim 9, further comprising relief portions included as part of the cylindrical extension, the relief portions extending between adjacent grooves.

11. The device of claim 6, wherein the device is made of a plastics material such as high density polyethylene or polypropylene.

* * * * *